US006609997B1

(12) United States Patent
Sardella et al.

(10) Patent No.: US 6,609,997 B1
(45) Date of Patent: Aug. 26, 2003

(54) METHOD AND APPARATUS FOR RESURFACING ANVIL BLANKET OF A ROTARY DIECUTTER FOR BOX MAKING MACHINE

(75) Inventors: Louis M. Sardella, Incline Village, NV (US); Yury Polikov, Baltimore, MD (US)

(73) Assignee: Sun Automation Inc., Sparks, MD (US)

( * ) Notice: Subject to any disclaimer, the term of this patent is extended or adjusted under 35 U.S.C. 154(b) by 0 days.

(21) Appl. No.: 09/471,011

(22) Filed: Dec. 23, 1999

(51) Int. Cl.[7] ..... B31B 1/64

(52) U.S. Cl. ..... 493/194; 493/355; 451/49; 451/69; 451/82; 451/142; 451/290; 451/424

(58) Field of Search ..... 493/194, 355; 451/49, 69, 72, 82, 83, 290, 424, 142; 83/174, 174.1

(56) References Cited

U.S. PATENT DOCUMENTS

| | | | | | |
|---|---|---|---|---|---|
| 92,309 | A | * | 7/1869 | Hastings | 451/424 |
| 3,601,928 | A | * | 8/1971 | Miller | 451/14 |
| 4,331,053 | A | * | 5/1982 | Imai et al. | 493/355 |
| 4,736,660 | A | * | 4/1988 | Benach et al. | 493/355 |
| 5,131,966 | A | * | 7/1992 | Coffey | 156/296 |
| 6,106,448 | A | * | 8/2000 | Obara et al. | 493/11 |

FOREIGN PATENT DOCUMENTS

| | | | |
|---|---|---|---|
| JP | 1-67000 | A1 | 4/1969 |
| JP | 7-256791 | * | 10/1995 |

* cited by examiner

*Primary Examiner*—Rinaldi I. Rada
*Assistant Examiner*—Hemant M Desai
(74) *Attorney, Agent, or Firm*—William E. Mouzavires

(57) ABSTRACT

A rotary die cuter for a box making machine has an abrading cylinder mounted for rotation alongside the anvil for engaging and resurfacing the blanket of the anvil on a virtually continuous basis to smooth, level and even the surface of the blanket. This resurfacing occurs during normal operation of the rotary die cutter so no production is lost. The abrading cylinder has a sheet layer of abrasive material spirally wrapped on the surface of the cylinder and bonded thereto with adhesive material on the backside of the sheet layer. The abrading cylinder is movable towards or away from the anvil by a servo motor and gearbox. The position of the abrading cylinder relative to the anvil is determined by an encoder which sends the information to a computer or programmable controller which calculates the changing diameter of the blanket and the amount of speed change that must be imparted to the anvil to compensate for its changing diameter. The computer or programmable controller is connected to a drive system of the anvil to effect the speed change.

13 Claims, 4 Drawing Sheets

METHOD AND APPARATUS FOR RESURFACING ANVIL BLANKET OF A ROTARY DIECUTTER FOR BOX MAKING MACHINE

FIELD OF INVENTION

The present invention generally relates to box making machines and more particularly to novel and improved methods and apparatus for resurfacing the anvil blanket of a rotary die cutter used to crease and/or cut corrugated boards in a box making machine.

BACKGROUND OF INVENTION

Rotary die cutters include a die drum or cylinder having on its surface a cutting die typically made of steel rule for cutting or creasing corrugated board against an anvil drum or cylinder as the board passes between the two drums. The anvil cylinder has a blanket on its circumferential surface typically made of urethane usually provided in 0.30 inch thick and 10 inch to 20 inch wide segments for ease of rotation and replacement. When the anvil blanket develops an irregular surface and becomes cut-up due to repeated contact from the steel rule dies on the die drum, the operation of the rotary die cutter must be stopped together with the production run of the box making machine. A cutting tool such as a knife or a rotating mill tool or grinding wheel is then operated while moved along the length of the surface of the blanket to trim the blanket to even and smooth it. Approximately 0.010 to 0.020 inches is trimmed from the blanket surface. The diameter of the blanket is then measured, and a speed compensator for the anvil is also adjusted since the diameter of the anvil has been reduced by the trimming operation. In this regard it is well known that the surface speed of the anvil affects the accuracy of the die cut in the corrugated board. Ideally the surface speed of the anvil should be equal to the speed of the board as it travels through the die cutter. However, due to the constant wear in the blanket surface, it is not possible to maintain a constant diameter of the blanket and nor is it practical to constantly stop production to trim the blankets, to measure the blanket diameter and adjust the speed compensator to change the speed of the anvil in accordance with its reduced diameter.

Prior methods have therefore resorted to trimming between 0.010 to 0.020 inches from the anvil blanket surface, at relatively large intervals of time in order to avoid constant shut down of the box making machine for resurfacing the anvil blanket. The result is that conventional rotary die cutters used in box making machines are subject to inaccurate die cuts or creases in the corrugated boards while shortening the life of the anvil blanket.

OBJECTS OF THE INVENTION

One of the objects of the present invention is to provide a novel and improved rotary die cutter for a box making machine which overcomes the above noted problems attending conventional rotary die cutters used in the box making industry today.

Another object of the present invention is to provide novel and improved methods and apparatus for resurfacing or trimming an anvil blanket of a rotary die cutter for box making machines to improve the accuracy and consistency of the cutting and creasing of the corrugated boards. Included herein are methods and apparatus for automatically adjusting the speed of the anvil to compensate for the surface material removed from the anvil during resurfacing.

A further object of the present invention is to provide such method and apparatus for trimming or resurfacing an anvil blanket of a rotary die cutter and for controlling an associated anvil speed compensator while the die cutter is operating during a production run thereby avoiding the need to shut down production.

A still further object of the present invention is to provide such method and apparatus for resurfacing or trimming a rotary die cutter which increase the life of the anvil blanket. Included herein are such method and apparatus which allow only a minimum amount of surface material preferably between 0.0005 to 0.002 inches to be trimmed from the anvil blanket as the blanket surface becomes irregular during use.

Yet another object of the present invention is to provide such method and apparatus which may be applied to conventional rotary die cutters for resurfacing or trimming their anvil blankets.

SUMMARY OF PREFERRED EMBODIMENT OF THE PRESENT INVENTION

A rotary die cutter having a die drum and an anvil drum is provided with an abrader cylinder mounted alongside and generally coextensive with the anvil drum for rotation against the anvil blanket to trim the surface of the blanket. In operation the abrader cylinder is moved virtually continuously against the anvil blanket as the die cutter is operating on corrugated boards. The abrader cylinder rotates in the same rotatative direction as the anvil and has an abrasive surface which abrades or grinds the blanket surface to a smooth, even and level condition. A motor and encoder assembly is provided to drive the abrader cylinder towards or away from the anvil drum and to record the position and the amount of movement of the abrader cylinder which information is fed to a computer or programmable controller for calculating the diameter of the anvil blanket surface and the amount of speed change needed in the anvil to compensate for the change in diameter of the anvil blanket surface.

DRAWINGS

Other objects and advantages of the present invention will be apparent from the following more detailed description of the present invention taken in conjunction with the attached drawings in which.

DETAILED DESCRIPTION

Figure 1:
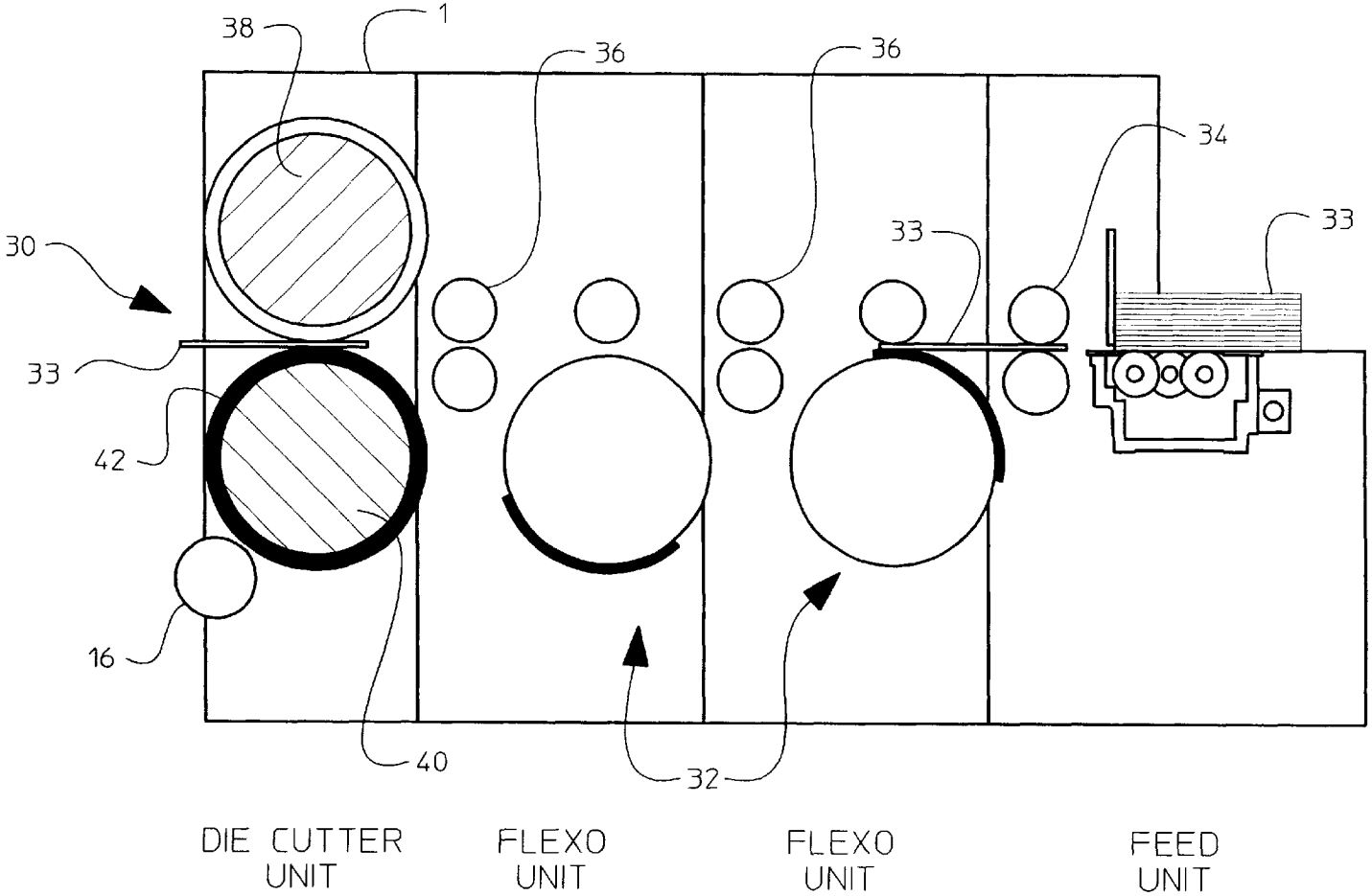
FIG. 1 is a schematic view of a box making machine incorporating a rotary die cutter embodying the present invention.

Referring to the drawings in detail there is shown in FIG. 1 for illustrative purposes only a rotary die cutter generally designated 30 in a box making machine including two printing assemblies 32 each including an impression cylinder and a print cylinder. Corrugated boards 33 are initially fed to the machine by feed rolls 34 and subsequently transported by the printing cylinders and pull rolls 36.

Figure 3:
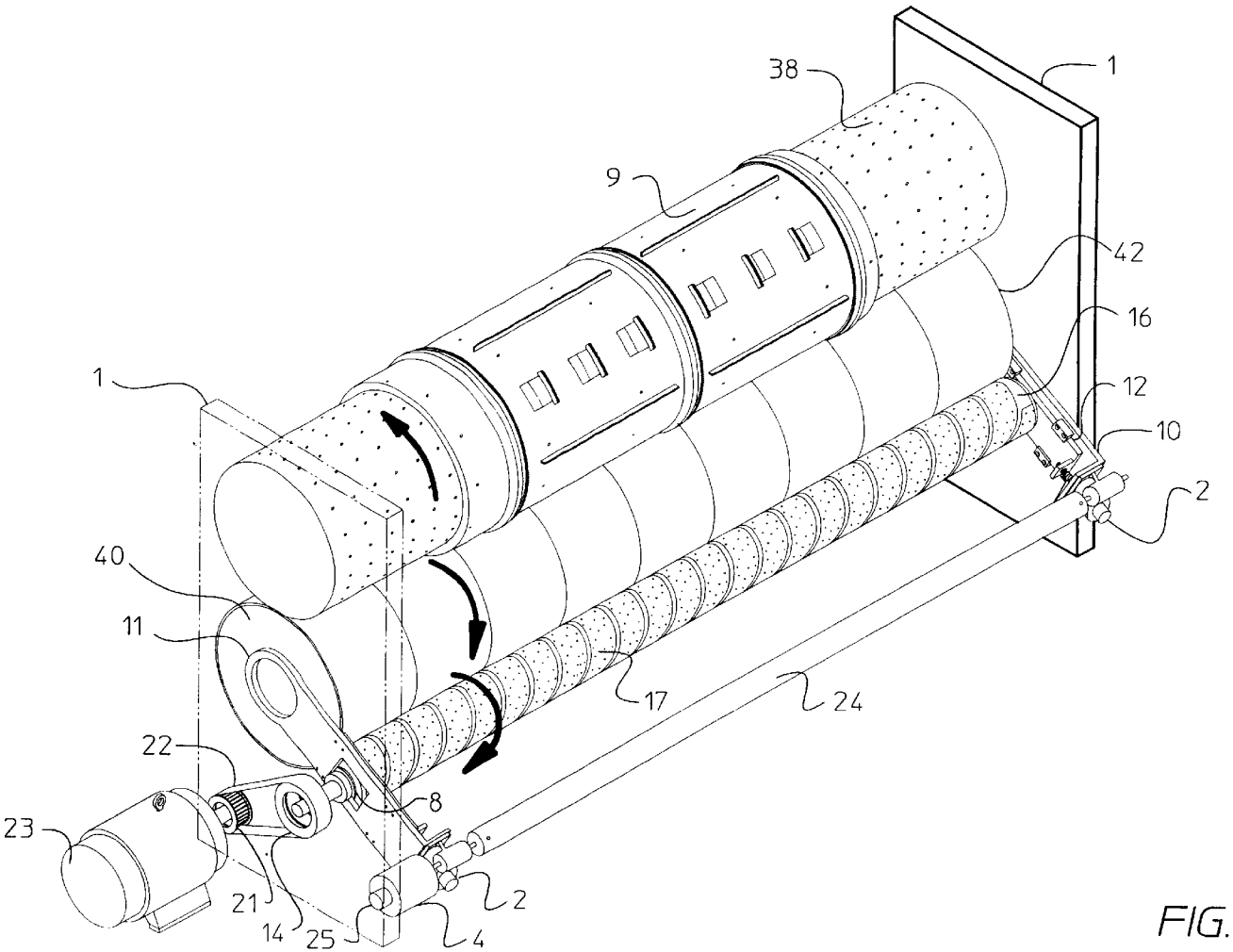
FIG. 3 is a perspective view of the rotary die cutter and the abrading cylinder and its associated mounting and drive members.

Die cutter 30 includes a cutting die cylinder 38 and an anvil cylinder 40 which receive in their nips corrugated boards 33 to be cut or creased by a cutting die usually steel rules 9 affixed on the peripheral surface of the cutting die cylinder 38 as shown in FIG. 3 to cut corrugated board against the anvil 40. The anvil cylinder includes a cylinder drum made of steel and an anvil blanket 42 typically made of urethane wrapped and fixed around the surface of the steel drum to cover it as shown in FIG. 3. Anvil cylinder 40 is journalled in opposite frames 1 for rotation by any suitable motor or by any other power input such as gears.

Figure 2:
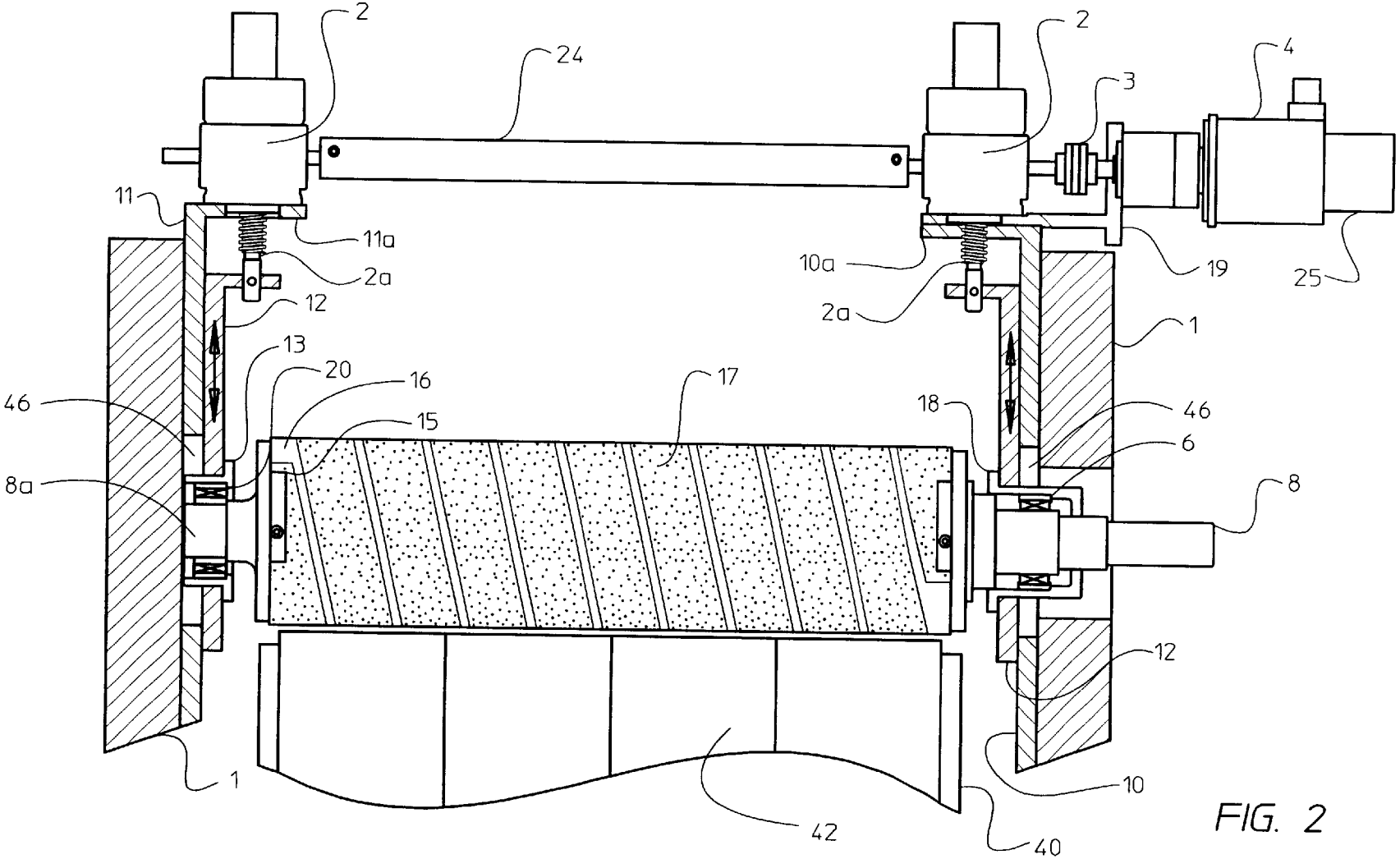
FIG. 2 is a cross-sectional view of a portion of the rotary die cutter incorporating an abrading cylinder in accordance with the present invention.

In accordance with the present invention an abrader or grinder drum or cylinder 16 is mounted for rotation alongside of and parallel to the anvil cylinder 40 as shown in FIGS. 1 and 2. Abrader cylinder 16 includes a cylindrical steel core body covered with a sheet layer of abrading material 17 bonded to the core by any suitable adhesive on the backside of the sheet opposite the abrasive side. The ends are held in place with clamp pieces 15 fastened to the cylinder 16 by screws. The abrading material may be of any suitable type such as sold by 3M and is applied by spirally wrapping it about the core as best shown in FIG. 3. Other abrading surfaces may be used on or formed integral with abrading cylinder 16.

Abrading drum 16 is provided on its opposite ends with mounting shafts 8 and 8*a* received in bearings 6 and 20 which are mounted through retaining members 18 and 13 in slidable frames 12 for movement along fixed frames 10 and 11 mounted on the anvil bearing housing. The latter, in the specific embodiment shown, include horizontal shelf portions 10*a* and 11*a* to which are mounted jack screw boxes 2 for driving the abrader cylinder 16 towards or away from the anvil drum 40 for positioning the abrading cylinder 16. Jack screw boxes 2 have output shafts 2*a* connected to frames 12 to move the frames 12 and the abrader cylinder 16 carried by the frames 12. In the specific embodiment shown, slots 46 are provided in frames 10 and 11 to accommodate movement of the bearings 6 and 20 towards or away from the anvil cylinder 40. Jack screws 2 are driven by a servo motor 4 connected by a coupling 3 to one of the Jack screws 2 which is connected by a connecting shaft 24 to the other Jack screw to drive the same. In another embodiment (not shown) two servo motors 4 may be used, one for each Jack screw 2. In this embodiment the connecting shaft 24 is of course eliminated. As shown in FIG. 3, mounting shaft 8 of abrading cylinder 16 is connected by a pulley and belt assembly 14, 21, and 22 to any suitable motor 23 to rotate the abrading cylinder 16. Motor 23 may be driven continuously during operation of the rotary die cutter 30 or only during a resurfacing operation as will be described.

In use, abrading cylinder 16 while rotating in the same direction as the anvil 40 is gradually positioned and advanced against the entire length of the anvil urethane blanket 42 by the motor 4 to trim and resurface the entire blanket until it is even, level and smooth. After each surfacing operation, the abrading cylinder 16 is backed off the anvil an amount for example 0.010 inches to disengage from the anvil. As little as 0.0005 to 0.002 inches of the blanket depth need be removed by the abrader drum 16 to provide a new smooth, even and level blanket surface 42. This is a marked improvement over conventional trimming tools which remove 0.010 to 0.020 inches of the blanket at each resurfacing operation thereby creating periods, during the intervals between resurfacing, of inaccurate and inconsistent cutting and creasing when compared to the abrading drum 16 of the present invention. In addition the abrading drum 16 resurfaces the anvil blanket while the die cutter is operating on corrugated boards 33 during a production run. Therefore production is not stopped while the blanket is being resurfaced which takes only about one or two minutes as opposed to one half to one hour with conventional resurfacing methods and tools. The resurfacing operation is initiated in the preferred embodiment about every ten thousand (10,000) revolutions of the anvil; however other parameters may be used depending on the wear of the anvil blanket. The resurfacing operation may be initiated by an operator or automatically through the use of suitable timing and computer controls for the motors 23 and 4. When the abrading surface 17 of the abrading drum 16 becomes worn the entire abrading layer 17 is simply removed and replaced with a new layer. This is more economical than replacing or sharpening a cutting tool used in conventional methods.

Figure 4:
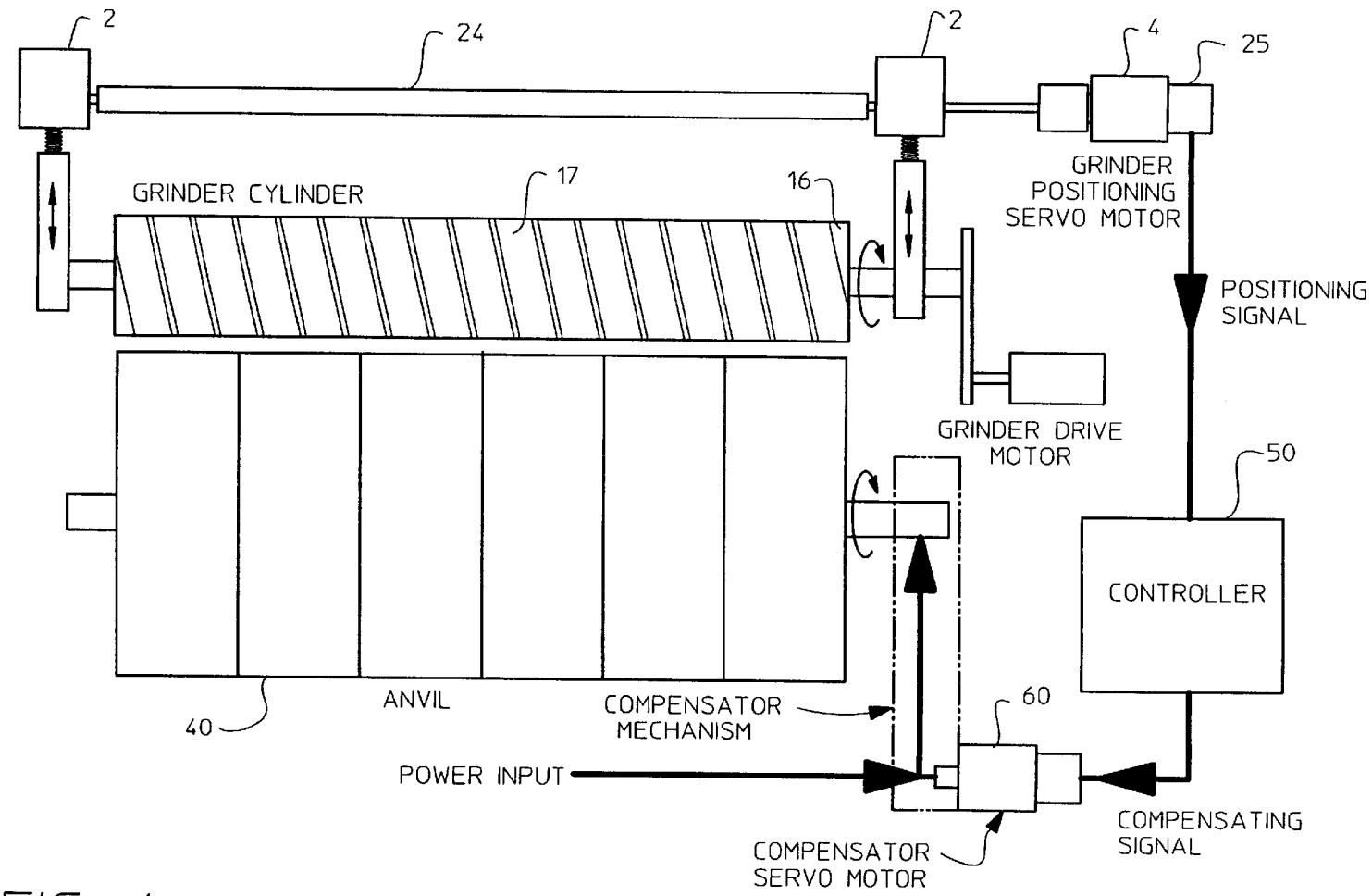
FIG. 4 is a schematic view including the anvil, abrader cylinder, and a computer or programmable controller connected between the motor and encoder assembly for the abrader cylinder and an anvil speed compensator for the anvil.

In addition, the position of the abrading cylinder 16 may be used during production without stoppage to automatically vary the speed of the anvil, through any conventional anvil compensator, to compensate for the reduction in the anvil diameter caused by the resurfacing operation. Referring to FIG. 4, the motor 4 for feeding the abrading cylinder 16 is provided with an encoder 25 for determining the position of the abrading cylinder and sending it to the computer or programmable controller 50 which determines the changing diameter of the anvil blanket and the consequent speed change which must be imparted to the anvil. Computer or programmable controller 50 is connected to a speed compensator motor 60 or other device of any suitable or conventional type which is connected to the anvil to change the speed to suit the diameter of the anvil.

Since only a very small amount of material is removed from the blanket at each resurfacing operation, and the anvil blanket is left smooth, even and level, the precise diameter of the anvil can be determined from the position of the abrading cylinder. In the embodiment described herein the anvil 40 is provided with a power input from a motor or shaft and a compensator motor for adding to or subtracting from the velocity imported to the anvil by the power input. In other embodiments, the anvil may be provided with only one motor which can be speed adjusted to compensate for the change in diameter of the anvil as a result of resurfacing or when a new anvil blanket is provided on the anvil. In another embodiment the same end result may be achieved through a v belt pulley drive system by changing the diameter of the pulley belt which drives the anvil or other similar variable speed mechanical drives may be used.

When a new or different anvil blanket 42 is applied to the anvil cylinder 40, the box making machine is of course stopped. After the application of the new or different blanket 42, the abrading cylinder is advanced by its positioning motor 4 to engage the new or different blanket until a high load in the positioning motor 4 is sensed. The motor 4 is then de-energized and the position of the abrading cylinder noted by the computer or programmable logic controller 50 to determine and record the starting diameter of the new or different anvil blanket 42. The abrader cylinder 16 is then backed off the anvil blanket 42 a slight amount for example 0.010 inches to provide a clearance therebetween, and the amount backed off is also recorded by the computer or programmable controller 50. The operation of the box making machine is then commenced and when a certain predetermined amount, for example, ten thousand revolutions of the anvil 40 is reached the positioning motor 4 of the abrader cylinder 16 will be energized either automatically or manually by an operator to advance the abrading cylinder 16 against the anvil blanket to resurface the same. The amount of advancement of the abrading cylinder equals the amount it was initially backed off the anvil blanket plus a predetermined, programmed amount preferably between 0.0005 and 0.002 inches. At the conclusion of the resurfacing operation the abrader cylinder is automatically backed off the anvil blanket by the same amount indicated above for example 0.010 inches. From the amount of movement of the abrading cylinder the computer or programmable logic controller will calculate the change in diameter of the anvil and send a signal to the speed compensator motor 60 to change the speed of the anvil accordingly so that the proper surface speed is maintained. The above resurfacing process is repeated until the anvil blanket becomes worn at which time the box-making machine is stopped and a new or different anvil blanket replaces the worn one. The above procedure is then used at the start of a new production run.

In addition to the advantages pointed out above, the present invention may be used to remove ink from an anvil blanket to ready it for a new operation. This can be achieved due to the fact that the abrading cylinder removes very little material from the surface of the anvil. In addition, the present invention extends the life of the anvil not only by removing an exceedingly small amount of material during each resurfacing, but also because it keeps the surface of the anvil blanket virtually constantly smooth thereby reducing the amount of penetration by the blades of the cutting die cylinder.

Although a preferred embodiment of the present invention has been shown and described above, variations of the present invention will become apparent to those skilled in the art but without departing from scope of the present invention which is indicated in the appended claims.

What is claimed is:

1. In a box making machine including a rotary die cutter, the method of resurfacing the blanket of the anvil of the rotary die cutter including the steps of abrading the surface of the blanket with a rotating abrading cylinder engaging the surface of the blanket during box production while the rotary die cutter is cutting or creasing corrugated boards, and using the position of the abrading cylinder relative to the anvil to determine how much the speed of the anvil should be changed to compensate for the change in the diameter of the anvil, and wherein during box production while the die cutter is operating on the boards the abrading cylinder through the use of a computer is automatically and repeatedly fed radially into the anvil blanket a predetermined amount and then retracted from the anvil blanket to repeatedly resurface the anvil blanket, and the change in the diameter of the anvil blanket is automatically computed and the speed of the anvil is automatically changed to compensate for the change in the diameter of the anvil blanket.

2. The method defined in claim 1 including the step of abrading approximately 0.0005 to 0.002 inches off the surface of the blanket.

3. The method defined in claim 1 further including the step of repeating the abrading step at short intervals of approximately every ten thousand revolutions of the anvil during box production so that the blanket is virtually continuously resurfaced.

4. The method defined in claim 1 including the step of mounting the abrading cylinder on the housing of the anvil for lateral movement towards or away from the anvil blanket.

5. The method defined in claim 1 including the step of using a logic device to calculate the diameter of the anvil in response to a change in the position of the abrading cylinder relative to the anvil and for actuating a motor for changing the speed of the anvil to compensate for a change in diameter of the anvil.

6. The method defined in claim 1 further including the steps of removing the blanket from the anvil after it becomes worn, applying a new blanket on the anvil, advancing the abrading cylinder against the new blanket with the use of a motor until a high load is recognized by the motor, recording on the computer the position of the abrading cylinder to determine and record the starting diameter of the new blanket, then backing the abrading cylinder off the anvil blanket a slight amount and recording in the computer the amount the abrading cylinder was backed off the anvil blanket.

7. In a rotary die cutter for a box-making machine including a die cutter and an anvil cylinder including a blanket on the surface thereof, the improvement comprising an abrading cylinder mounted for rotation along the anvil cylinder for abrading the surface of the blanket, means including a computer for automatically and repeatedly moving the abrading cylinder radially towards and away from the blanket to bring the abrading cylinder into and out of engagement with the anvil blanket to resurface the blanket during box production while the die cutter is operating on corrugated boards, and means including said computer for automatically determining the position of the abrading cylinder relative to the anvil for calculating the diameter of the anvil and automatically changing the speed of the anvil in accordance with the diameter of the anvil during box production while the die cutter is operating on corrugated boards.

8. The improvement defined in claim 7 including bearings mounting the abrading cylinder for rotation about the axis of the abrading cylinder, a pair of frames respectively mounted on the opposite ends of the anvil and receiving said bearings, and a motor for moving said bearings towards or away from said anvil cylinder.

9. The improvement defined in claim 8 including frame portions receiving said bearings and being slidable along said frames.

10. The improvement defined in claim 8 including an encoder associated with said motor for determining the position of the abrading cylinder relative to the anvil, said computer receiving information from said encoder, and a motor controlled by said computer for changing the speed of the anvil to compensate for changes in the diameter of said anvil.

11. The improvement defined in claim 10 wherein said means includes means for automatically starting and stopping said motors.

12. In a rotary die cutter as defined in claim 7 wherein said means for determining the position of the abrading cylinder relative to the anvil and calculating the diameter of the anvil includes an encoder and said computer is connected to the encoder.

13. In a rotary die cutter as defined in claim 12 wherein said means for automatically changing the speed of the anvil cylinder includes a motor automatically driven under the control of said computer.

* * * * *